US010796838B2

(12) United States Patent
Lai et al.

(10) Patent No.: US 10,796,838 B2
(45) Date of Patent: Oct. 6, 2020

(54) NETWORK TRANSFORMER MODULE

(71) Applicant: Delta Electronics, Inc., Taoyuan (TW)

(72) Inventors: Chin-Hsin Lai, Taoyuan (TW); Li-O Lee, Taoyuan (TW); Chia-Kai Weng, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 307 days.

(21) Appl. No.: 15/825,679

(22) Filed: Nov. 29, 2017

(65) Prior Publication Data

US 2019/0043652 A1 Feb. 7, 2019

(30) Foreign Application Priority Data

Aug. 4, 2017 (TW) ..... 106211505 U

(51) Int. Cl.

| | |
|---|---|
| ***H01F 27/24*** | (2006.01) |
| ***H01F 17/08*** | (2006.01) |
| ***H01F 5/04*** | (2006.01) |
| ***H01F 27/38*** | (2006.01) |
| ***H01F 27/28*** | (2006.01) |
| ***H01F 17/04*** | (2006.01) |
| ***H01F 19/06*** | (2006.01) |
| ***H01F 38/00*** | (2006.01) |

(52) U.S. Cl.

CPC ..... *H01F 17/08* (2013.01); *H01F 5/04* (2013.01); *H01F 17/04* (2013.01); *H01F 19/06* (2013.01); *H01F 27/24* (2013.01); *H01F 27/28* (2013.01); *H01F 27/38* (2013.01); *H01F 38/00* (2013.01); *H01F 2005/043* (2013.01); *H01F 2038/006* (2013.01)

(58) Field of Classification Search

CPC ..... H01F 5/00; H01F 5/04; H01F 27/00–40
USPC ..... 336/65, 83, 170–173, 180–184, 200, 336/220–223, 232–234
See application file for complete search history.

(56) References Cited

U.S. PATENT DOCUMENTS 5,999,066 A * 12/1999 Saito ..... H03H 7/46 333/132
2010/0298825 A1* 11/2010 Slizynski ..... A61B 18/042 606/41
2019/0043651 A1* 2/2019 Zhang ..... H01F 41/08

FOREIGN PATENT DOCUMENTS

JP 2018170397 A * 11/2018 ..... H01F 27/292

* cited by examiner

*Primary Examiner* — Tuyen T Nguyen
(74) *Attorney, Agent, or Firm* — Muncy, Geissler, Olds & Lowe, P.C.

(57) ABSTRACT

A network transformer module includes a first magnetic element and a second magnetic element. The first magnetic element includes a first iron core and a first coil winding. The first coil winding is composed of a first wire and a second wire, and is wrapped 7 to 14 turns around the first iron core. The second magnetic element includes a second iron core and a second coil winding. The second coil winding is composed of a third wire and a fourth wire, and is wrapped 2 to 5 turns around the second iron core.

16 Claims, 3 Drawing Sheets

NETWORK TRANSFORMER MODULE

CROSS REFERENCE TO RELATED APPLICATIONS

This Application claims priority of Taiwan Patent Application No. 106211505, filed on Aug. 4, 2017, the entirety of which is incorporated by reference herein.

BACKGROUND OF THE INVENTION

Field of the Invention

The application relates in general to a transformer, and in particular to a network transformer module.

Description of the Related Art

As users' demands on networks increases, the speed of such networks has increased rapidly in recent years. In order to perform signal transmission and noise suppression, most known network transformer modules are usually equipped with a transformer and a common mode choke. However, existing network transformers usually operate at network speeds below 1G BASE-T, so if they are used directly in a higher speed network environment, the bandwidth may be limited, which can result in problems like packet transmission failure. Therefore, how to provide a network transformer module having a larger bandwidth and stable signal transmission function in the high-speed network speed environment is a problem that needs to be solved immediately.

BRIEF SUMMARY OF INVENTION

An embodiment of the present invention provides a network transformer module, including a first magnetic element and a second magnetic element. The first magnetic element includes a first iron core and a first coil winding. The first coil winding winds around the first iron core, and is composed of a first wire and a second wire. The first coil winding is wound 7 to 14 turns around the first iron core. The second magnetic element includes a second iron core and a second coil winding. The second coil winding is wound around the second iron core, and is composed of a third wire and a fourth wire. The second coil winding is wound 2 to 5 turns around the second iron core.

According to another embodiment of the present invention, the first coil winding forms M layers of coil on the first iron core, wherein M is a positive integer that is greater than 2.

According to another embodiment of the present invention, the second coil winding forms N layers of coil on the second iron core, wherein N is a positive integer that is greater than 1.

According to another embodiment of the present invention, the number of turns in each layer of the first coil winding is the same, and the number of turns in each layer of the second winding is the same.

According to another embodiment of the present invention, the ratio of M to N is 2:1.

According to another embodiment of the present invention, the first magnetic element is a transformer, and the second magnetic element is a common mode choke.

According to another embodiment of the present invention, when the network transformer module is used at a network speed of 2.5G BASE-T or below, the second magnetic element is arranged between the first magnetic element and a signal input terminal.

According to another embodiment of the present invention, when the network transformer module is used at a network speed of 2.5G BASE-T or below, the second magnetic element is arranged between the first magnetic element and a signal output terminal.

According to another embodiment of the present invention, when the network transformer module is used at a network speed of 5G BASE-T or above, the second magnetic element is arranged between the first magnetic element and a signal input terminal and between the first magnetic element and a signal output terminal.

According to another embodiment of the present invention, the signal input terminal is a physical side, and the signal output terminal is a cable side.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Further areas to which the present network transformer modules can be applied will become apparent from the detailed description provided herein. It should be understood that the detailed description and specific examples, while indicating exemplary embodiments of network transformer modules, are intended for the purposes of illustration only and are not intended to limit the scope of the invention.

Figure 1:
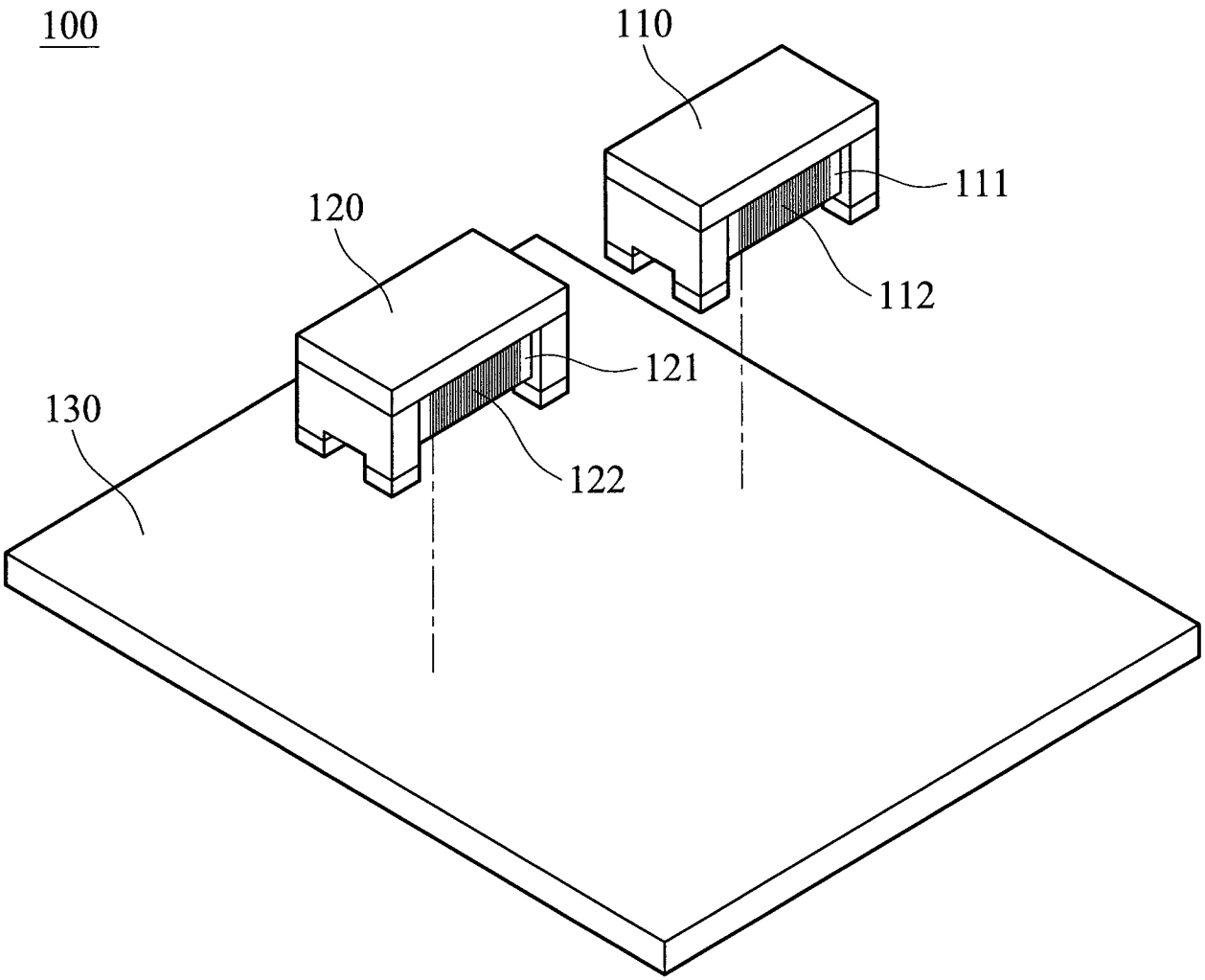
FIG. 1 illustrates a schematic diagram of a network transformer module in accordance with an embodiment of the present invention.

FIG. 1 illustrates a schematic diagram of a network transformer module in accordance with an embodiment of the present invention. As shown in FIG. 1, the network transformer module 100 includes at least one first magnetic element 110, at least one second magnetic element 120 and a connecting plate 130. The first magnetic element 110 and the second magnetic element 120 can be arranged on the connecting plate 130 by plugging or soldering the pins of the first magnetic element 110 and the second magnetic element 120 in the connecting plate 130 or by other means. The first magnetic element 110 can be a transformer for transmitting signals, and is composed of a first iron core 111 and a first coil winding 112. The first coil winding 112 is made of two wires wound around the first iron core 111. The second magnetic element 120 can be a common mode choke for suppressing noise, and is composed of a second iron core 121 and a second coil winding 122. The second coil winding 122 can be made of two wires or three wires, and winds around the second iron core 121. The first coil winding 112 and the second coil winding 122 will not directly couple with each other, and the first coil winding 112 will not wind around the second iron core 121 and the second coil winding 122 will not wind around the first iron core 111. The connecting plate 130 can be a carrier made of a conductive material, such as a circuit board, a conductive frame or a substrate, etc., for electrically coupling the first magnetic element 110 and the second magnetic element 120 while the first magnetic element 110 and the second magnetic element 120 are arranged on the connecting plate through the pins.

For the transformer, the number of turns of the core winding is proportional to the inductance value, but inversely proportional to the bandwidth. Therefore, when there are too few turns of the coil winding around the iron core, the signal baseline may be offset since the inductance value is insufficient, and then the signal may not be transmitted normally. On the other hand, too many turns of the coil winding around the iron core will limit the bandwidth. For the common mode choke, when there are too few turns of the coil winding around the iron core, the signal will be disturbed by noise, which may result in problems such as signal loss. Similarly, too many turns of the coil winding around the iron core may also limit the bandwidth. Thus, the first coil winding 112 and the second coil winding 122 can have different configurations when the network transformer module 110 is applied to different bandwidths.

According to a first embodiment of the present invention, when the network transformer module 100 is used at a network speed of 1G BASE-T or below, such as 10/100 BASE-T, 1G BASE-T, etc., there are 7 or more turns of the first coil winding 112 around the first iron core 111, and at least two layers of the first coil winding 112 are formed on the first iron core 111. In addition, there are 2 or more turns of the second coil winding 112 around the second iron core 121, and one or more layers of the second coil winding 112 are formed on the second iron core 121. The ratio of the number of layers of the first coil winding 112 and the second coil winding 122 around their respective cores is 2:1, and the number of turns in each layer is the same. For example, if the first magnetic element 110 is a two-layer structure and the number of turns is 14, this means that two layers of the first coil winding 112 are formed on the first iron core 111 and the number of turns in each layer is 14, and the second magnetic element 120 is a single layer structure and the number of turns is 2 or more.

According to a second embodiment of the present invention, when the network transformer module 100 is used at a network speed above 1G BASE-T, e.g., 2.5G BASE-T, 5G BASE-T, 10G BASE-T, etc., there are 7 to 14 turns of the first coil winding 112 around the first iron core 111, and at least two layers of the first coil winding 112 are formed on the first iron core 111. In addition, there are 2 to 5 turns of the second coil winding 112 around the second iron core 121, and one or more layers of the second coil winding 112 are formed on the second iron core 121. Likewise, the ratio of the number of layers of the first coil winding 112 and the second coil winding 122 wound around their respective cores is 2:1, and the number of turns in each layer is the same. When the number of turns of the first coil winding 112 wound around the first iron core 111 is greater than 14 or the number of turns of the second coil winding 122 wound around the second iron core 121 is greater than 5, the maximum bandwidth of the network transformer module 100 is only about 1G, and there will be a problem of packet transmission failure. In other words, when the number of turns of the first coil winding 112 wound around the first iron core 111 is less than 7 or the number of turns of the second coil winding 122 wound around the second iron core 121 is less than 2, and there will be a problem of insufficient inductance value or noise interference.

Figure 2A:
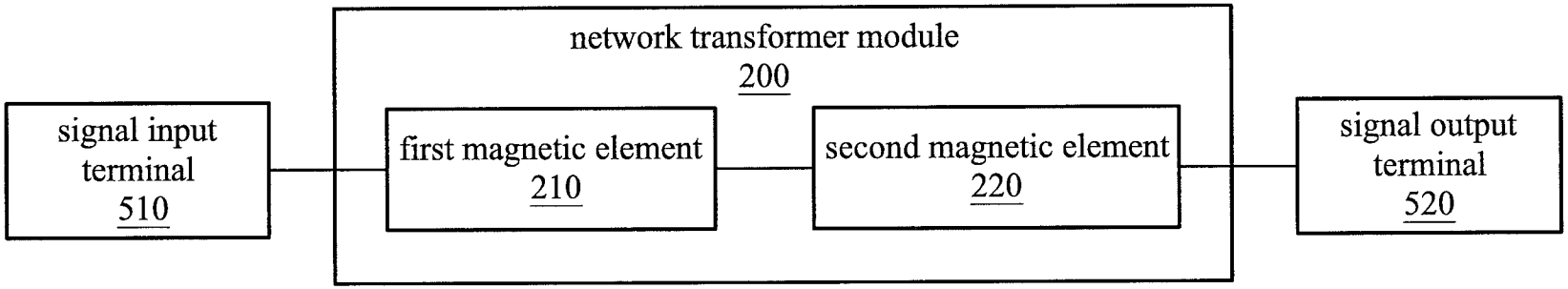
FIGS. 2A and 2B are schematic diagrams of some configurations of the network transformer module in accordance with some embodiments of the present invention.
Figure 2B:
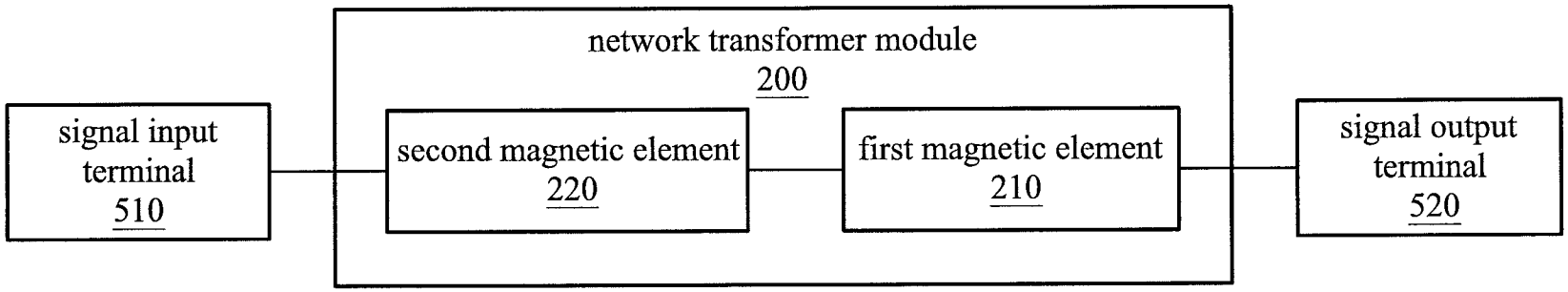

FIGS. 2A and 2B are schematic diagrams of the configurations of the network transformer module 200 used at a network speed of 2.5 G BASE-T or below in accordance with some embodiments of the present invention. When the network transformer module is operated at a network speed below 1G BASE-T, the configuration of the first magnetic element 210 and the second magnetic element 220 is the same as the configuration described in the first embodiment. When the network transformer module is operated at a network speed of 2.5G BASE-T, the arrangement of the first magnetic element 210 and the second magnetic element 220 is the same as the configuration described in the second embodiment, thus it will not be described herein to simplify the description. As shown in FIG. 2A, the network transformer module 200 has a first magnetic element 210 and a second magnetic element 220. The first magnetic element 210 is directly coupled to a signal input terminal 510 and the second magnetic element 220 is directly coupled to a signal output terminal 520: i.e., the second magnetic element 220 is coupled between the first magnetic element and the signal output terminal 520.

According to another embodiment of the present invention, as shown in FIG. 2B, the network transformer module 200 also has a first magnetic element 210 and a second magnetic element 220. However, in this embodiment, the first magnetic element 210 is directly coupled to the signal output terminal 520 and the second magnetic element 220 is directly coupled to the signal input terminal 510. In other words, the second magnetic element 220 is coupled between the first magnetic element and the signal input terminal 510. The signal input terminal 510 is a chip side (physical side) and the signal output terminal 520 is a network side (cable side).

Figure 3:
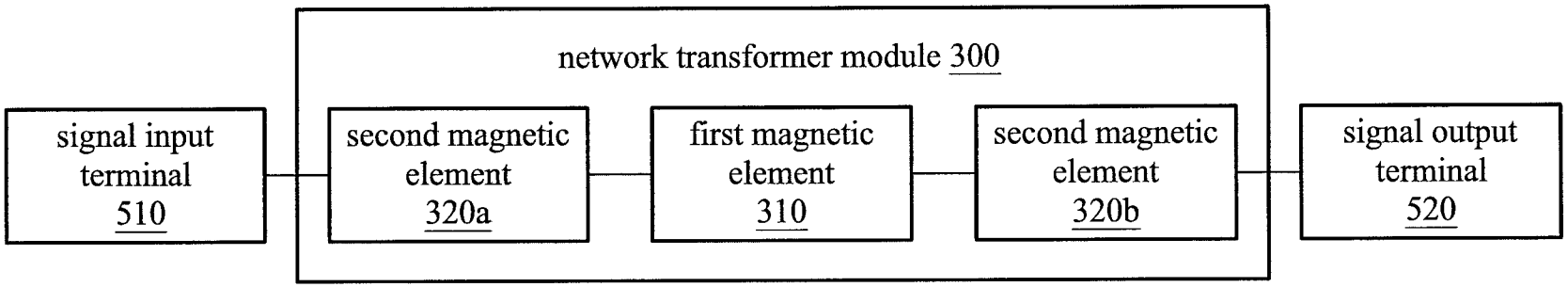
FIG. 3 illustrates a schematic diagram of another configuration of the network transformer module in accordance with another embodiment of the present invention.

Please refer to FIG. 3, which illustrates a schematic diagram of the configuration of a network transformer module 300 used at a network speed of 5G BASE-T: i.e., 5G BASE-T, 10G BASE-T or above, in accordance with another embodiment of the present invention. The configuration of the first magnetic element 310 and the second magnetic elements 320*a* and 320*b* is the same as the configuration described in the second embodiment, so it will not be described again herein to simplify the description. As shown in FIG. 3, the network transformer module 300 has a first magnetic element 310 and two second magnetic elements 320*a* and 320*b*. The second magnetic element 320*a* is directly coupled to the signal input terminal 510, the second magnetic element 320*b* is directly coupled to the signal output terminal 520, and the first magnetic element 310 is coupled between the second magnetic element 320*a* and the second magnetic element 320*b*.

As described above, according to the network transformer modules of the present invention, it is possible to perform signal transmission and noise suppression by changing the configuration of the magnetic elements in the network transformer module. Also, the problem of narrow bandwidth and packet transmission failure can be solved by using the network transformer module in different configurations at different network speeds.

It will be apparent to those skilled in the art that various modifications and variations can be made to the structure disclosed without departing from the scope or spirit of the invention. In view of the foregoing, it is intended that the present invention covers modifications and variations of this invention, provided they fall within the scope of the following claims and their equivalents.

What is claimed is:

1. A network transformer module, comprising:

a first magnetic element, comprising:

a first iron core; and a first coil winding, wound around the first iron core;

wherein the first coil winding is wound 7 to 14 turns around the first iron core;

wherein the first coil winding is composed of a first wire and a second wire; and a second magnetic element, comprising:

a second iron core; and a second coil winding, wound around the second iron core;

wherein the second coil winding is wound 2 to 5 turns around the second iron core;

wherein the second coil winding is composed of a third wire and a fourth wire;

wherein the first coil winding forms M layers of coil on the first iron core and M is a positive integer greater than 2;

wherein the second coil winding forms N layers of coil on the second iron core, and N is a positive integer greater than 1;

wherein the number of turns in each layer of the first coil winding is the same, and the number of turns in each layer of the second winding is the same; and wherein a ratio of M to N is 2:1.

2. The network transformer module as claimed in claim 1, wherein the first magnetic element is a transformer, and the second magnetic element is a common mode choke.

3. The network transformer module as claimed in claim 2, wherein when the network transformer module is used at a network speed of 2.5G BASE-T or below, the second magnetic element is arranged between the first magnetic element and a signal input terminal.

4. The network transformer module as claimed in claim 2, wherein when the network transformer module is used at a network speed of 2.5G BASE-T or below, the second magnetic element is arranged between the first magnetic element and a signal output terminal.

5. The network transformer module as claimed in claim 2, wherein when the network transformer module is used at a network speed of 5G BASE-T or above, the second magnetic element is arranged between the first magnetic element and a signal input terminal and between the first magnetic element and a signal output terminal.

6. The network transformer module as claimed in claim 3, wherein the signal input terminal is a physical side, and the signal output terminal is a cable side.

7. The network transformer module as claimed in claim 4, wherein the signal input terminal is a physical side, and the signal output terminal is a cable side.

8. The network transformer module as claimed in claim 5, wherein the signal input terminal is a physical side, and the signal output terminal is a cable side.

9. A network transformer module, comprising:

a first magnetic element, comprising:

a first iron core; and a first coil winding, wound around the first iron core, wherein the first coil winding is wound 7 to 14 turns around the first iron core, wherein the first coil winding is composed of a first wire and a second wire; and a second magnetic element, comprising:

a second iron core; and a second coil winding, wound around the second iron core, wherein the second coil winding is wound 2 to 5 turns around the second iron core, wherein the second coil winding is composed of a third wire and a fourth wire, wherein the first coil winding forms M layers of coil on the first iron core, and M is a positive integer greater than 2, wherein the second coil winding forms N layers of coil on the second iron core, and N is a positive integer greater than 1, and wherein a ratio of M to N is 2:1.

10. The network transformer module as claimed in claim 9, wherein the first magnetic element is a transformer, and the second magnetic element is a common mode choke.

11. The network transformer module as claimed in claim 10, wherein when the network transformer module is used at a network speed of 2.5G BASE-T or below, the second magnetic element is arranged between the first magnetic element and a signal input terminal.

12. The network transformer module as claimed in claim 10, wherein when the network transformer module is used at a network speed of 2.5G BASE-T or below, the second magnetic element is arranged between the first magnetic element and a signal output terminal.

13. The network transformer module as claimed in claim 10, wherein when the network transformer module is used at a network speed of 5G BASE-T or above, the second magnetic element is arranged between the first magnetic element and a signal input terminal and between the first magnetic element and a signal output terminal.

14. The network transformer module as claimed in claim 11, wherein the signal input terminal is a physical side, and the signal output terminal is a cable side.

15. The network transformer module as claimed in claim 12, wherein the signal input terminal is a physical side, and the signal output terminal is a cable side.

16. The network transformer module as claimed in claim 13, wherein the signal input terminal is a physical side, and the signal output terminal is a cable side.

* * * * *